XR 3,951,663

United States Patent [19]
Ross
SUBSTITUTE FOR MISSING XR
[11] 3,951,663
[45] Apr. 20, 1976

[54] ORGANIC VOLUME PHASE HOLOGRAPHIC RECORDING MEDIA COMPRISING AN α DI-KETONE

[75] Inventor: Daniel Louis Ross, Princeton, N.J.

[73] Assignee: RCA Corporation, New York, N.Y.

[22] Filed: Oct. 4, 1973

[21] Appl. No.: 403,377

[52] U.S. Cl. ..... 96/67; 96/27 H; 96/115 R; 350/3.5; 204/159.16

[51] Int. Cl.[2] ..... G03C 1/76; G03C 1/68

[58] Field of Search..... 96/27 H, 67, 35.1, 115 R; 350/3.5; 204/159.16

[56] References Cited

UNITED STATES PATENTS

| | | | |
|---|---|---|---|
| 3,547,509 | 12/1970 | Brandes | 350/3.5 |
| 3,580,657 | 5/1971 | Sheridon | 96/27 H |
| 3,658,526 | 4/1972 | Haugh | 96/27 H |
| 3,707,371 | 12/1972 | Files | 96/27 H |
| 3,764,333 | 10/1973 | Leclair et al. | 96/67 |
| 3,809,686 | 5/1974 | Chandross et al. | 96/27 H |

*Primary Examiner*—Edward C. Kimlin
*Attorney, Agent, or Firm*—Glenn H. Bruestle; Birgit E. Morris

[57] ABSTRACT

Certain light sensitive α-diketones dissolved in a cured light-insensitive transparent polymer host form recording media useful for recording volume phase holograms.

8 Claims, 4 Drawing Figures

ORGANIC VOLUME PHASE HOLOGRAPHIC RECORDING MEDIA COMPRISING AN α DI-KETONE

ORGANIC VOLUME PHASE HOLOGRAPHIC RECORDING MEDIA

This invention relates to a recording medium for volume phase holography. More particularly, this invention relates to a recording medium for volume phase holograms comprising certain α-diketones dissolved in a cured polymeric host.

CROSS REFERENCES TO RELATED APPLICATIONS

This application discloses subject matter which is related to the disclosure in copending application of Bloom and Bartolini entitled "Permanent Organic Volume Phase Holographic Recording Media" Ser. No. 403,408, filed Oct. 4, 1973.

BACKGROUND OF THE INVENTION

The advent of volume phase holography has stimulated research into better materials for recording and readout of the stored holographic information. Volume phase holograms are produced by changes in refractive index of selected portions of the recording medium, as contrasted with other holographic recording media, such as absorption holograms, which depend upon changes in optical density, or relief holograms which depend upon the formation of surface relief patterns for example, for holographic recording. Volume phase holography is more efficient than other systems since very little light is absorbed by the recording medium during readout, and they can be employed in thick sections, whereas other recording media can only be employed in sections of one millimeter or less in thickness.

Recording of volume phase holograms in said recording media consists of generating an interference pattern through the interaction between a coherent reference light beam and an object light beam. The object beam carries the spatial modulation corresponding to the image to be recorded. The light pattern formed by the interference of the object beam and the reference beam causes a change in the index of refraction of the recording media. The refractive index pattern produced thereby is a three-dimensional pattern which is representative of the object recorded. Readout is done with coherent light travelling in the direction of the reference beam and is phase modulated in accordance with the refractive index pattern, thereby reproducing the object beam through wavefront reconstruction.

Various materials which change their index of refraction upon exposure to coherent light have been investigated in the past with some success. For example, single crystals of electro-optic materials such as lithium niobate are known to provide volume phase holographic recording media. However, their efficiency is low and, in untreated crystals, the holograms are erased when coherent readout light of the same intensity as that used for recording is directed at the crystal. Doped crystals are also known and these provide higher efficiency holograms and can be treated so that the holographic information is made permanent. However, these crystals are difficult and expensive to obtain and the treatment requires additional equipment and processing steps.

Organic materials have been disclosed as holographic recording media also. Some change their index of refraction by changes in density brought about by photopolymerization. Others do so by photoreversible dimerization of guest molecules.

SUMMARY OF THE INVENTION

We have discovered that certain α-diketones dissolved in certain polymeric precursors which, when cured, form transparent light-insensitive solids, are excellent volume holographic recording media. These recording media have a threshold for efficient recording; above a critical value of incident light intensity, holograms having high diffraction efficiency can be recorded rapidly. Readout with light of an intensity below this critical value can be carried out for prolonged periods with no degradation of the stored holograms.

DETAILED DESCRIPTION OF THE INVENTION

Figure 1:
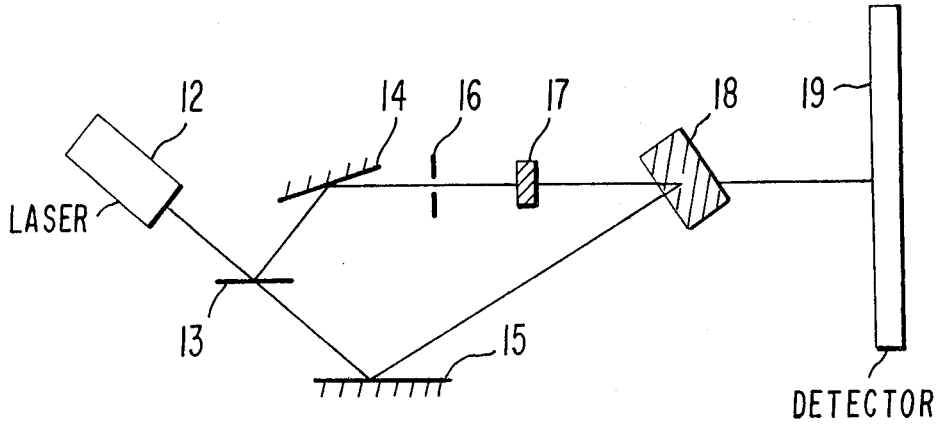
FIG. 1 is a schematic diagram of an apparatus suitable for recording volume phase holograms.

The α-diketones suitable for use in the novel recording medium have the general formula

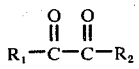

wherein $R_1$ and $R_2$ independently are aliphatic or aromatic hydrocarbon radicals or $R_1$ and $R_2$ together can form a cyclic hydrocarbon radical. Such α-diketones include for example straight chain aliphatic α-diketones such as

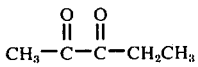

2,3-pentanedione,

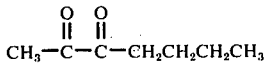

2,3-heptanedione,

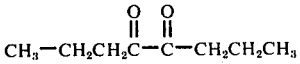

4,5-octanedione and the like;

branched chain aliphatic α-diketones such as

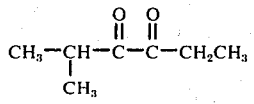

2-methyl-3,4-hexanedione,

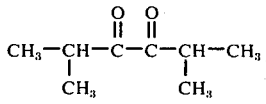

2,5-dimethyl-3,4-hexanedione and the like; cycloaliphatic α-diketones such as

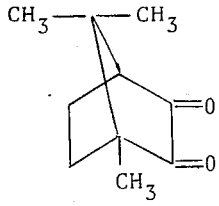

camphorquinone,

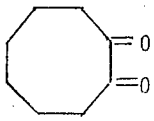

1,2 cyclooctanedione and the like; unsaturated cycloaliphatic α-diketones such as

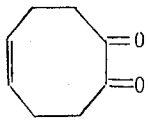

5-cyclooctene-1,2-dione

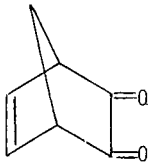

5-norbornene-2,3-dione and the like; alkaryl α-diketones such as

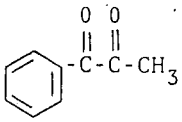

1-phenyl-1,2-propanedione

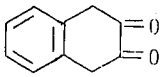

1,4-dihydro-2,3-napthoquinone

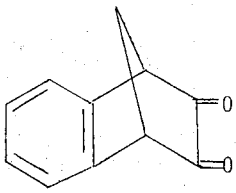

1,4-dihydro-1,4-methanonapthalene-2,3-dione and the like; and aromatic α-diketones such as

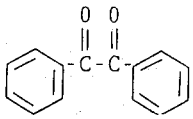

benzil,

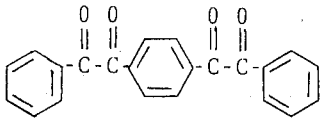

1,4-bis(phenylglyoxalyl)benzene

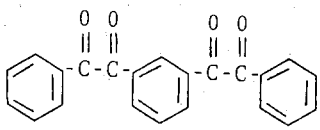

1,3-bis(phenylglyoxalyl)benzene and the like.

The α-diketones preferred herein have absorption band wavelength tails correspondng to the wavelengths used for recording.

The polymeric host suitable for use in the invention must be able to dissolve the desired α-diketone in its uncured and cured states and form a transparent, light-insensitive solid when cured. The polymer should be curable at relatively low temperatures as well. Polymers which require high temperatures for curing may have an adverse effect on the α-diketone. Suitable host materials include acrylic polyesters which are curable at room temperature with free radical initiators, e.g., peroxides, such as Castolite Liquid Casting Plastic AP resin, commercially available from The Castolite Company, epoxy resins of the epichlorohydrin-Bisphenol A type, such as Maraset Epoxy Resin No. 655, commercially available from the Marblette Corporation and other epoxy resins, including Stycast 1266, a two-part room temperature curable epoxy resin derived from maleic anhydride and commercially available from Emerson and Cuming, Inc. The host is chosen so that it is light-insensitive at recording and readout wavelengths and so that it will impart desirable mechanical and optical properties.

The choice of α-diketone, host polymer and concentration of α-diketone depends upon several factors; the wavelength of light the host is designed for; the solubility of the α-diketone in the uncured host material; the molecular weight of the α-diketone; the absorption spectrum of the α-diketone in the wavelength region used during recording and readout; and the thickness of the recording medium. The α-diketone will be chosen so that its absorption band wavelength tail is close to the recording wavelength or that it will have low optical density at that wavelength, e.g., less than about 0.2. This allows high concentrations of the α-diketone to be employed with little or no loss in efficiency. Amounts of about 0.1 to about 25 percent by weight of the α-diketone in the host can be used. As an illustration of the above, for thick samples of about 1 cm, 5 percent of camphorquinone in Castolite can be employed at 5145 Angstroms wavelength but not at 4880 Angstroms. However, in thinner sections, about 1 mm thick, the 4880 Angstrom wavelength would be satisfactory.

The recording media as hereinabove described are prepared simply by dissolving the α-diketone in the uncured polymer precursor and curing the solution to form clear, solid castings of the shape and thickness desired. The castings can also be cut and polished after casting to obtain the desired shape and thickness.

FIG. 1 is a schematic diagram of a system useful for recording and readout of holographic information in the recording media described above. Referring now to FIG. 1, the system includes a laser 12 which emits a coherent light beam. The light beam passes through a beam splitter 13. A portion of the beam is reflected from the beam splitter 13 onto a first mirror 14; the remainder of the light beam passes through onto a second mirror 15. The mirrors 14 and 15 are adjusted so that the plane polarized beams reflected from them meet at an angle of 30°–45°. The portion of the beam reflected from the beam splitter 13 is the object beam. The object beam passes through a shutter 16 and then through the object to be recorded 17. The portion of the beam which passes through the beam splitter 13 is the reference beam. The recording medium 18 is positioned at the intersection of the reference and object beams. During readout, the shutter 16 is closed and only the reference beam passes through to the recording medium. The image can be viewed on a detector screen 19.

When more than one image is to be recorded in the recording medium, means for rotating or otherwise changing the selected portion of the recording medium exposed to the light beams can be provided. During readout, means to rotate the recording medium or means to change the position or angle of the reference beam at the required angle of incidence is also provided.

The invention will be further illustrated by the following examples, but it is to be understood that the invention is not meant to be limited to the details described therein. In the examples, parts are by weight.

EXAMPLE 1

One gram of 2,3-pentanedione was admixed with 20 grams of Castolite AP resin. Fourteen drops of Castolite hardener were added, the mixture was stirred and then placed in a vacuum dessicator for several minutes to remove any gas bubbles. The solution was poured into several 1 centimeter (hereinafter cm) thick molds and allowed to cure at room temperature for 5 days.

Figure 2:
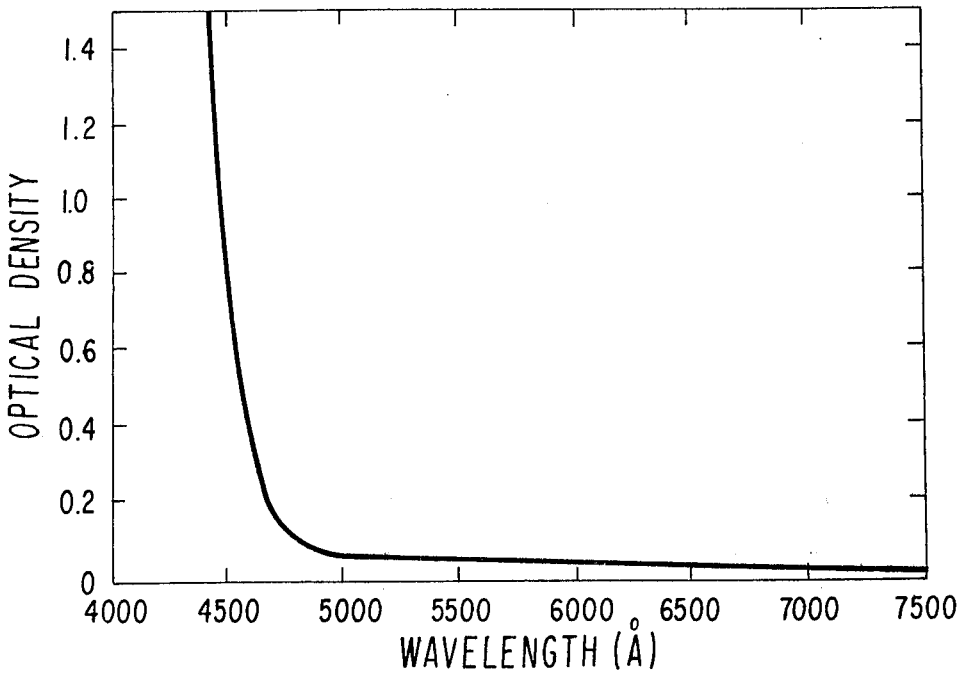
FIG. 2 is a graph of optical density versus wavelength of a recording medium of the invention.

The castings after removal from the molds were clear and hard and of a light yellow color. A graph of the optical density as a function of wavelength is shown in FIG. 2.

A sample 1 cm cube was cut from the casting and polished. Holograms were recorded in an apparatus as shown in FIG. 1 using an argon laser of 5145 Angstroms wavelength. The beam power density was measured first at 3 cm behind the sample. Initially, the power with the sample out was 29 mW/cm$^2$; with the sample in, it was 19 mW/cm$^2$. No holograms were recorded after 500 seconds. The power was increased to 120 mW/cm$^2$ and then to 200 mW/cm$^2$. After 550 seconds, the holographic efficiency was about 8 percent. The power was then increased to 1W/cm$^2$. Holographic efficiency was about 13 percent after 150 seconds, but it decreased to a low level after 350 seconds. When the recording medium was rotated slightly, the efficiency returned to about 10 percent. After standing overnight, the reference beam was turned on and the efficiency was about 0 percent, but rotation of the recording medium again produced a hologram at about 10 percent efficiency. The laser reference beam was left on at a low power level, 50 mW/cm$^2$ for about 3 hours. The efficiency remained at about 10 percent. Rotation of the recording medium maximized the efficiency to about 17 percent.

Figure 3:
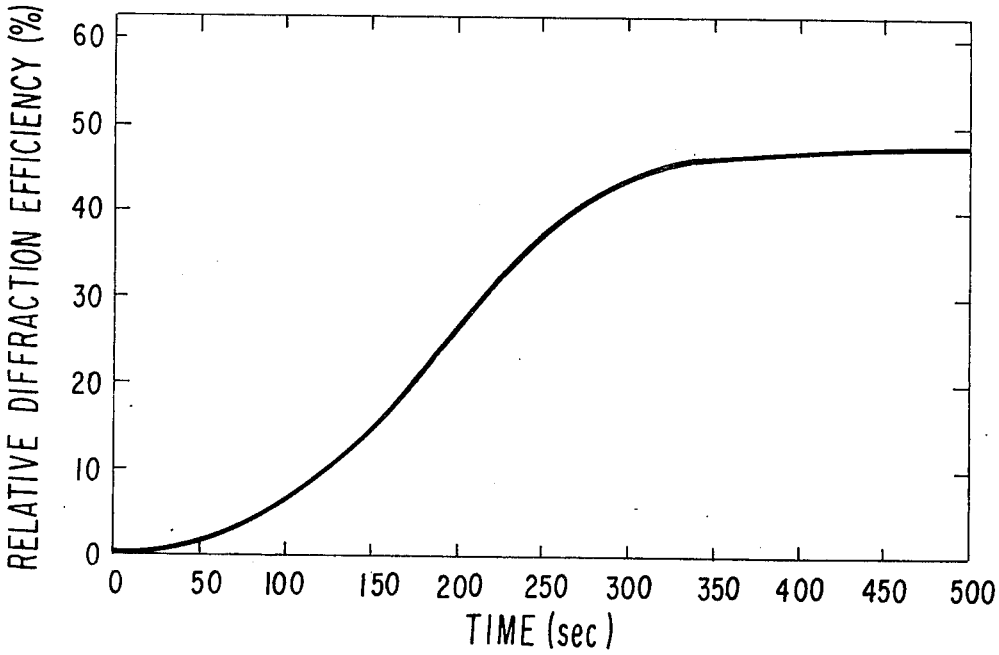
FIG. 3 is a graph of relative diffraction efficiency versus time of a recording medium of the invention.

FIG. 3 is a graph of the diffraction efficiency as a function of time for a 1 cm thick sample using a laser power of 0.6 W/cm$^2$.

EXAMPLE 2

One-half part of camphorquinone which had been recrystallized from cyclohexane was stirred with 10 parts of Maraset No. 655 resin and warmed at 40°C. until the diketone dissolved. The solution was cooled to room temperature and 0.7 part of Maraset hardener No. 555 was stirred in. The solution was degassed in a vacuum dessicator and then was poured into molds and cured at 75°C. overnight. The temperature was increased to 90°C. and curing continued for 48 hours.

Figure 4:
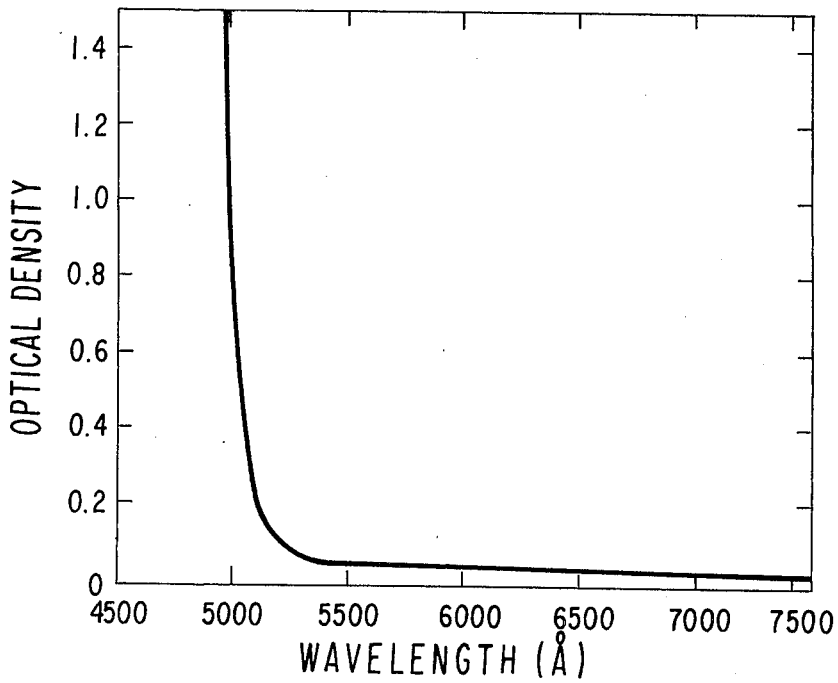
FIG. 4 is a graph of optical density versus wavelength of another recording medium of the invention.

The casting was light yellow and clear. The optical density of a 1 cm thick sample cut and polished was 0.12 at 5145 Angstroms and over 1.0 at 4880 Angstroms. FIG. 4 is a graph of optical density as a function of wavelength for this sample.

A sample 1 mm thick was cut and polished. An excellent hologram was recorded at 4880 Angstroms using 0.5 W/cm$^2$ power.

EXAMPLE 3

One-half part of recrystallized camphorquinone was added to 10 parts of Part A Stycast 1266 resin and the mixture was warmed slightly to dissolve the diketone. 0.14 Part of camphorquinone was added to 2.8 parts of Part B of the resin. The solutions were stirred together, degassed in a vacuum dessicator, poured into molds and cured at room temperature for 24 hours.

The optical density of a sample 1 cm thick was 0.17 at 5145 Angstroms. A hologram having an efficiency of about 10 percent was recorded in this sample using 5145 Angstroms light at 1 W/cm$^2$ for 100 seconds.

I claim:

1. A medium for recording volume phase holograms consisting essentially of a cured, insoluble, transparent light-insensitive polymeric host selected from the group consisting of acrylic polyesters and epoxy resins containing a soluble light-sensitive α-diketone having the formula

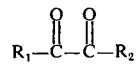

wherein $R_1$ and $R_2$ independently can be an aliphatic or aromatic hydrocarbon radical or together can form a carbocyclic ring, in an amount sufficient to cause a change in the index of refraction in the medium when illuminated by a spacially modulated coherent light beam having a wavelength corresponding to the absorption band wavelength tail of the α-diketone.

2. A recording medium according to claim 1 wherein the host is an acrylic polyester.

3. A recording medium according to claim 1 wherein the host is an epoxy resin derived from epichlorohydrin and Bisphenol A.

4. A recording medium according to claim 1 wherein the host is an epoxy resin derived from maleic anhydride.

5. A recording medium according to claim 2 wherein the α-diketone is 2,3-pentanedione.

6. A recording medium according to claim 2 wherein the α-diketone is camphorquinone.

7. A recording medium according to claim 3 wherein the α-diketone is camphorquinone.

8. A recording medium according to claim 4 wherein the α-diketone is camphorquinone.

* * * * *